US012703539B1

(12) United States Patent
Craig

(10) Patent No.: US 12,703,539 B1
(45) Date of Patent: Aug. 11, 2026

(54) SNACK BAG HOLDER DEVICE

(71) Applicant: Alta Craig, Bastrop, TX (US)

(72) Inventor: Alta Craig, Bastrop, TX (US)

( * ) Notice: Subject to any disclaimer, the term of this patent is extended or adjusted under 35 U.S.C. 154(b) by 0 days.

(21) Appl. No.: 19/220,814

(22) Filed: May 28, 2025

(51) Int. Cl.
*B65D 25/04* (2006.01)
*B65D 25/22* (2006.01)

(52) U.S. Cl.
CPC ..... *B65D 25/04* (2013.01); *B65D 25/22* (2013.01)

(58) Field of Classification Search
CPC ..... B65D 25/04; B65D 25/22
USPC ..... 220/480, 481, 482; 383/38, 39, 40; 211/85.4, 34, 35, 63, 85.15, 87.01
See application file for complete search history.

(56) References Cited

U.S. PATENT DOCUMENTS 2,533,725 A * 12/1950 Eisenberg ..... A47G 25/12 211/63
5,377,833 A * 1/1995 Ranger ..... B65D 75/66 206/427
5,490,607 A * 2/1996 Hsieh ..... A47G 21/14 220/232
5,503,476 A * 4/1996 Hamdan ..... D06F 95/002 383/86.2
5,533,534 A * 7/1996 Cariello ..... A47K 3/281 211/38
5,584,403 A * 12/1996 Sipperly ..... A47G 25/12 248/205.2
6,089,386 A 7/2000 Shiau
6,220,436 B1 * 4/2001 Chung ..... A45C 7/0095 206/424
6,279,204 B1 8/2001 Gonzalez
6,695,155 B1 * 2/2004 Sofy ..... D06F 81/006 211/87.01
D535,843 S 1/2007 Miller
D746,684 S 1/2016 Johnson
9,592,931 B2 3/2017 Woodruff
2005/0023235 A1 * 2/2005 Rodriguez ..... A47F 5/0884 211/85.15
2005/0121403 A1 * 6/2005 Stubbs ..... A47B 81/005 211/85.7
2007/0071366 A1 * 3/2007 Kao ..... B65D 81/3879 383/110
2007/0095769 A1 * 5/2007 Jenkins ..... A47K 10/38 211/119.009
2007/0205168 A1 9/2007 Helvey
2008/0302744 A1 * 12/2008 Rosenberg ..... A47F 5/0025 211/94.01
2016/0106208 A1 4/2016 Kirkpatrick
2017/0066550 A1 * 3/2017 Tsai ..... B65D 25/22

FOREIGN PATENT DOCUMENTS

WO WO2010019171 2/2010

* cited by examiner

*Primary Examiner* — Jacob K Ackun

(57) ABSTRACT

A snack bag holder device for storing bags of snacks without crushing the bags of snacks includes a panel that has a lobe portion extending upwardly from the panel and the panel has a hole extending through the lobe portion. A fastener is extendable through the hole to engage a support surface for suspending the panel on the support surface. A plurality of bowls is each coupled to the panel to contain respective ones of a plurality of bags of snacks. Additionally, each bowl of the plurality of bowls is concavely arcuate to inhibit the respective bags of snacks from being crushed.

12 Claims, 6 Drawing Sheets

SNACK BAG HOLDER DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to snack bag devices and more particularly pertains to a new snack bag device for storing bags of snacks without crushing the bags of snacks. The device includes a panel that has a lobe portion extending upwardly from the panel and a hole that extends through the lobe portion. The device further includes a fastener that is extendable through the hole to mount the panel to a support surface. Continuing, the device includes a plurality of bowls which are each coupled to the panel for storing bags of snacks. In addition, the plurality of bowls has a concavely arcuate shape to inhibit the bags of snacks from being crushed during storage.

(2) Description of Related Art Including Information Disclosed Under 37 CFR 1.97 and 1.98

The prior art relates to snack bag devices including a variety of snack bag storage devices that each at least includes a plurality of clips which grab bags of snacks for storage or rectilinear storage compartments for storing bags of snacks. In at least one instance the prior art discloses a snack bag storge device that combines rectilinear storage compartments and a plurality of clips. In no instance does the prior art disclose a snack bag storage device that includes a plurality of bowls which are concavely arcuate to store bags of snacks in a manner that inhibits the bags of snacks from being crushed prior to consuming the bags of snacks.

BRIEF SUMMARY OF THE INVENTION

An embodiment of the disclosure meets the needs presented above by generally comprising a panel that has a lobe portion extending upwardly from the panel and the panel has a hole extending through the lobe portion. A fastener is extendable through the hole to engage a support surface for suspending the panel on the support surface. A plurality of bowls is each coupled to the panel to contain respective ones of a plurality of bags of snacks. Additionally, each bowl of the plurality of bowls is concavely arcuate to inhibit the respective bags of snacks from being crushed.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
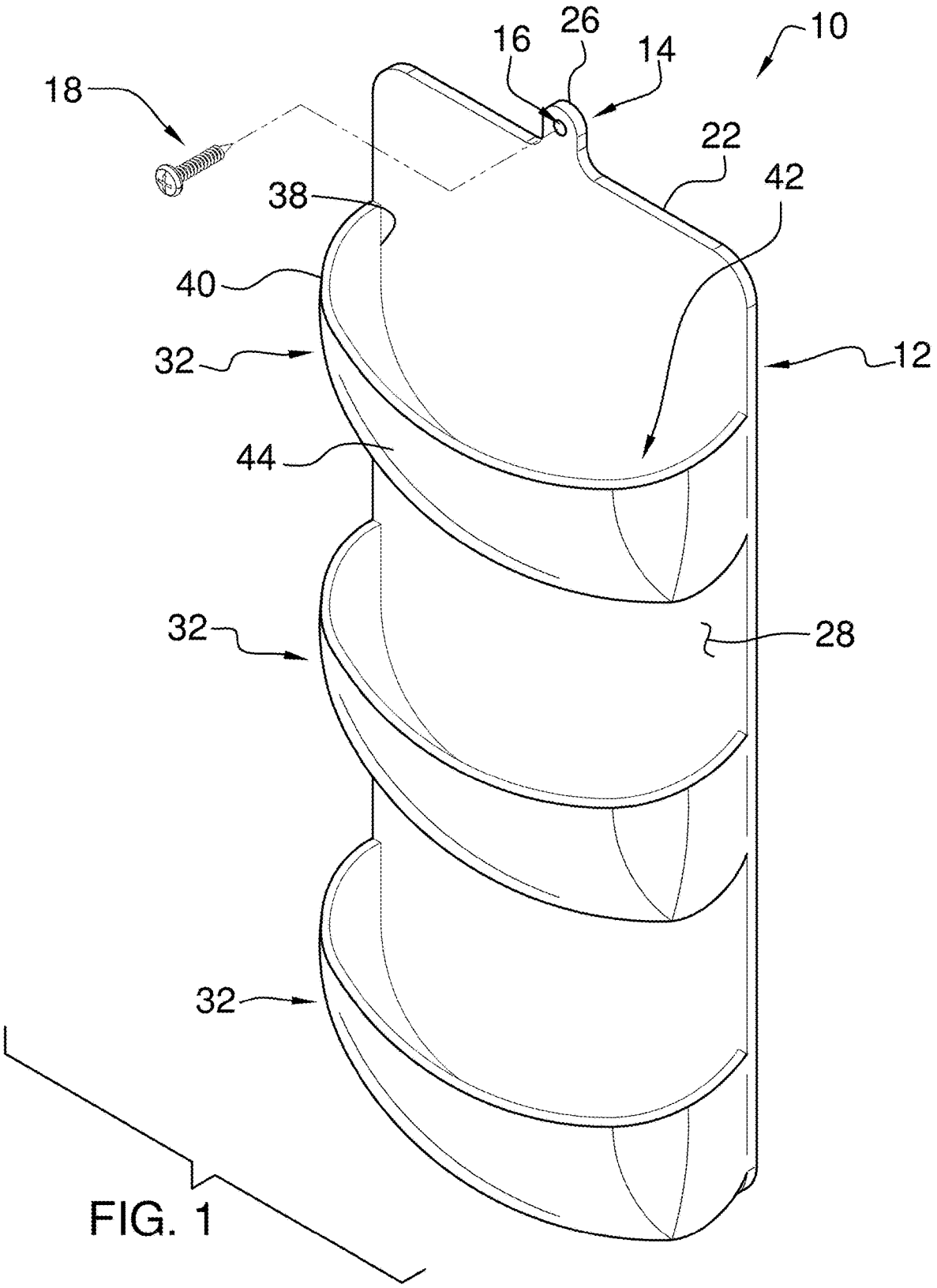
FIG. 1 is a perspective view of a snack bag holder device according to an embodiment of the disclosure.
Figure 2:
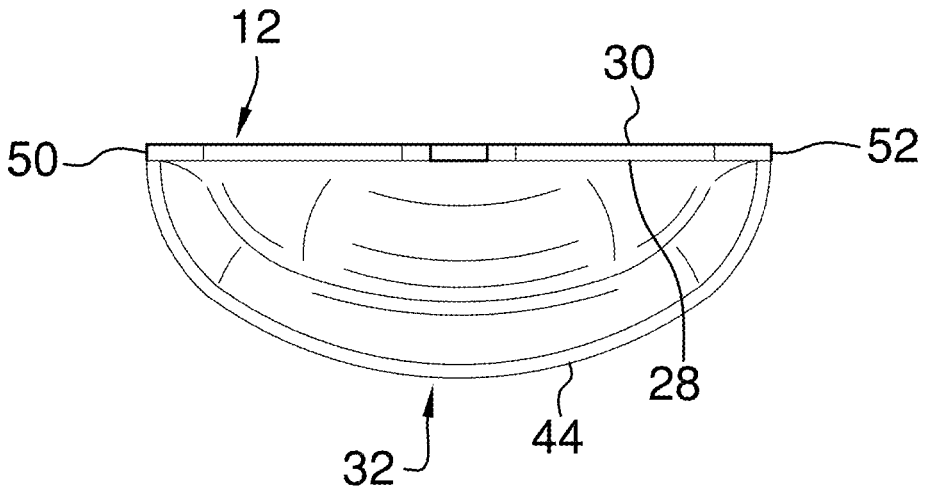
FIG. 2 is a top view of an embodiment of the disclosure.
Figure 3:
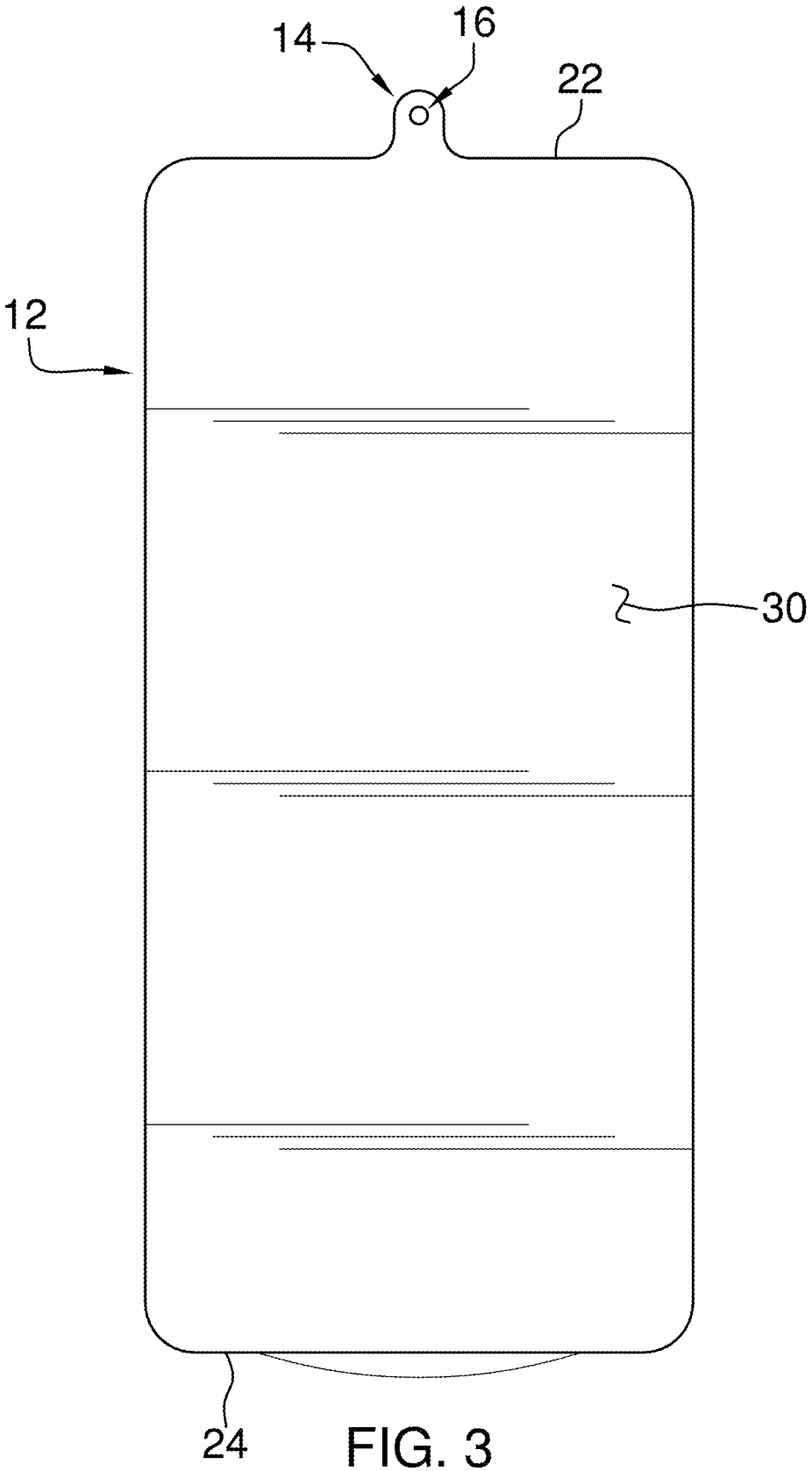
FIG. 3 is a back view of an embodiment of the disclosure.

With reference now to the drawings, and in particular to FIGS. 1 through 6 thereof, a new snack bag device embodying the principles and concepts of an embodiment of the disclosure and generally designated by the reference numeral 10 will be described.

As best illustrated in FIGS. 1 through 6, the snack bag holder device 10 generally comprises a panel 12 that has a lobe portion 14 extending upwardly from the panel 12 and the panel 12 has a hole 16 extending through the lobe portion 14. A fastener 18 is extendable through the hole 16 and the fastener 18 engages a support surface 20 for suspending the panel 12 on the support surface 20. The support surface 20 may be a wall in a kitchen, for example, or other type of vertical support surface. Additionally, the fastener 18 may be a screw or a nail or other type of penetrating fastener. The panel 12 has a top edge 22 and a bottom edge 24 and the panel 12 is elongated between the top edge 22 and the bottom edge 24. Additionally, the lobe portion 14 extends upwardly from the top edge 22 such that the panel 12 extends downwardly along the support surface 20 from the lobe portion 14.

The lobe portion 14 has a distal end 26 with respect to the top edge 22 and the distal end 26 is rounded to inhibit snagging on an object. The panel 12 has a front surface 28 and a back surface 30; the back surface 30 rests against the support surface 20. Furthermore, the hole 16 extends through the front surface 28 and the back surface 30 corresponding to the lobe portion 14. The panel 12 may have a length ranging between approximately 66.0 cm and 72.0 cm and a width ranging between approximately 30.0 cm and 35.0 cm.

A plurality of bowls 32 is each coupled to the panel 12 and each bowl 32 of the plurality of bowls 32 can contain respective ones of a plurality of bags of snacks 34. The bags of snacks 34 may include, but not be limited to, bags of potato chips or other types of snacks that are prone to being crushed. Each bowl 32 of the plurality of bowls 32 is concavely arcuate to inhibit the respective bags of snacks 34 from being crushed. Consequently, the bags of snacks 34 can be stored in a manner that preserves the contents of the bags of snacks 34 for the enjoyment of a user 36.

Figure 4:
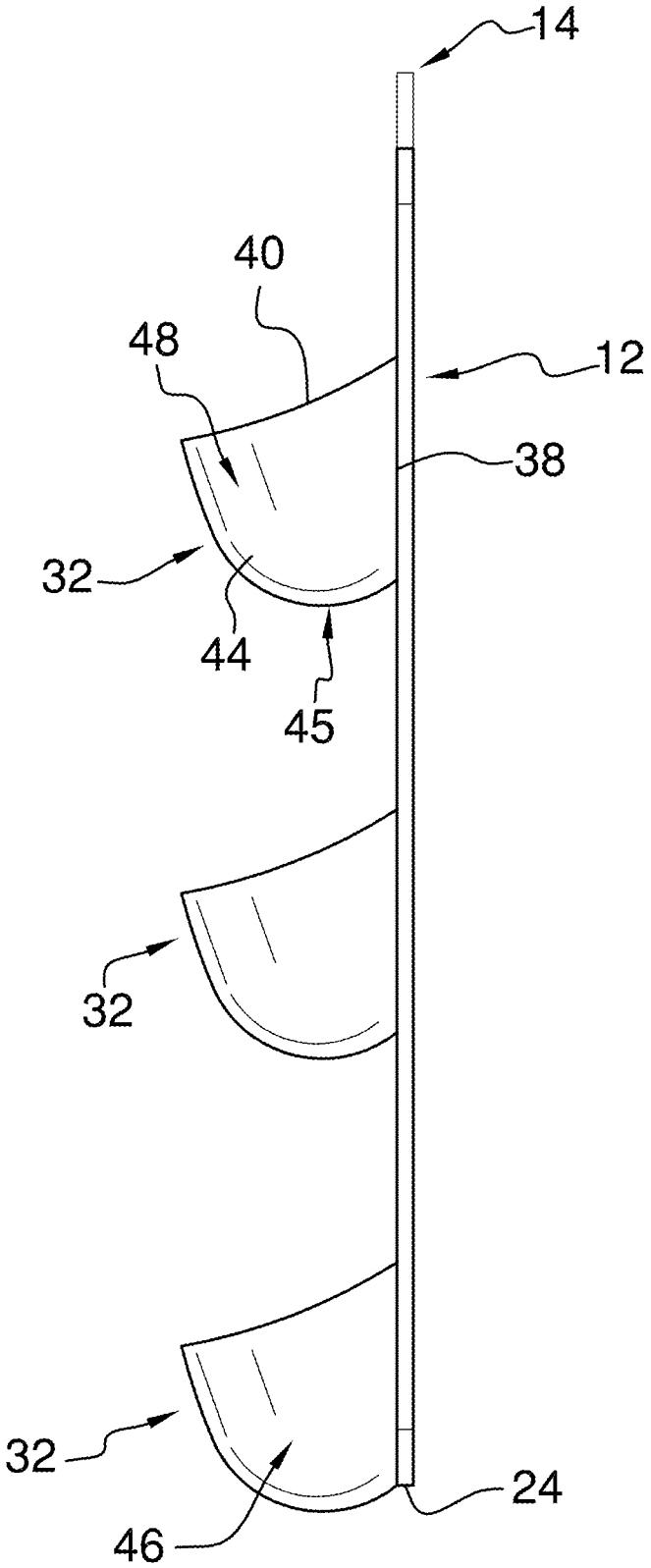
FIG. 4 is a right side view of an embodiment of the disclosure.
Figure 5:
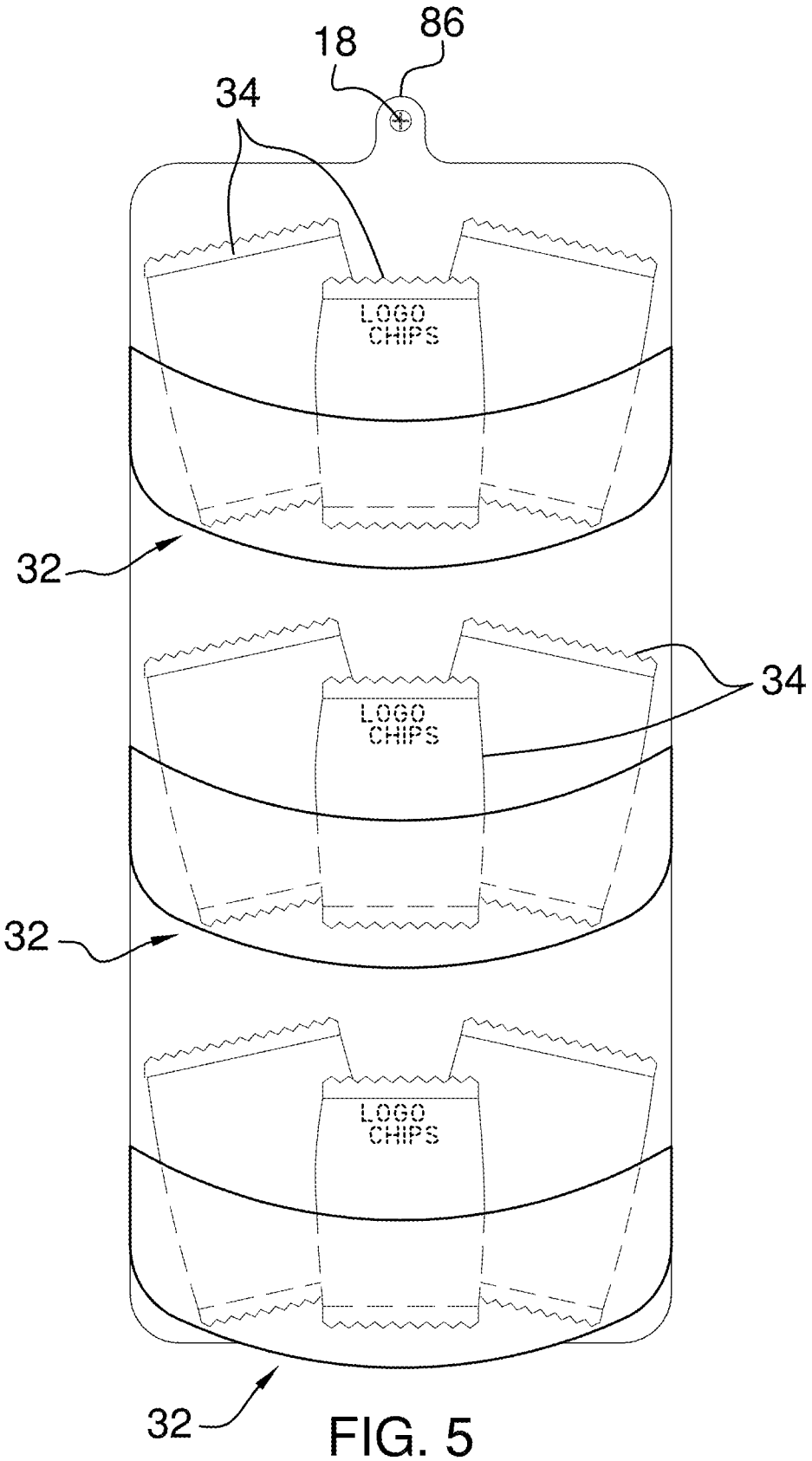
FIG. 5 is a phantom in-use view of an embodiment of the disclosure showing a plurality of bags of snacks being stored in a plurality of bowls.
Figure 6:
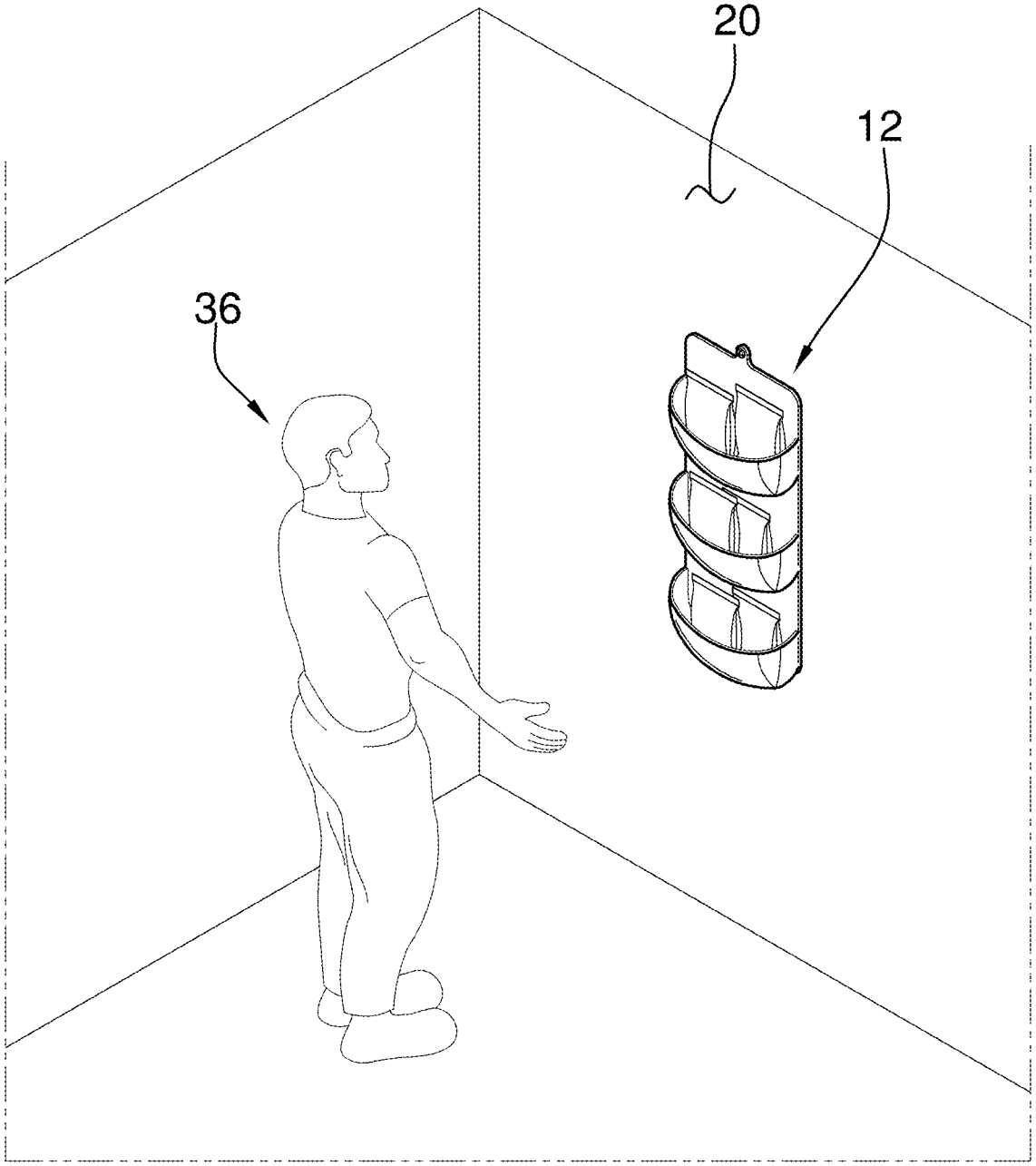
FIG. 6 is a perspective in-use view of an embodiment of the disclosure.

Each bowl 32 of the plurality of bowls 32 has a coupled edge 38 that is coupled to the front surface 28 of the panel 12 and each bowl 32 of the plurality of bowls 32 has an upper edge 40. The upper edge 40 of each bowl 32 of the plurality of bowls 32 curves forwardly from the coupled edge 38 of a respective bowl 32. Additionally, the upper edge 40 of each bowl 32 of the plurality of bowls 32 defines an opening 42 into an interior of a respective bowl 32. Furthermore, the opening 42 defined in each bowl 32 of the plurality of bowls 32 receives the respective bags of snacks 34. As is shown in FIG. 4, the upper edge 40 of each bowl 32 of the plurality of bowls 32 angles downwardly from the coupled edge 38 of a respective bowl 32 to expose an interior of the respective bowl 32 to the user 36 when the user 36 approaches the panel 12.

Each bowl 32 of the plurality of bowls 32 has an outer wall 44 extending between the upper edge 40 of a respective bowl 32 and the coupled edge 38 of the respective bowl 32. Additionally, the outer wall 44 of each bowl 32 of the plurality of bowls 32 is concavely arcuate between the upper edge 40 and the coupled edge 38. Furthermore, the outer wall 44 of each bowl 32 of the plurality of bowls 32 supports the bags of snacks 34. The plurality of bowls 32 is spaced apart from each other and is evenly distributed along a line extending between the top edge 22 of the panel 12 and the bottom edge 24 of the panel 12.

As is most clearly shown in FIG. 4, the outer wall 44 of each bowl 32 of the plurality of bowls 32 curves downwardly beyond the coupled edge 38 of a respective bowl 32 such that an apex 45 of the outer wall 44 is spaced below the coupled edge 38. Additionally, a lowermost one of the plurality of bowls 46 is aligned with the bottom edge 24 of the panel 12 and a topmost one of the plurality of bowls 48 is spaced downwardly from the top edge 22 of the panel 12. FIG. 4 shows that the outer wall of the lowermost bowl 46 curves downwardly beyond the bottom edge 24 of the panel 12. In addition, the panel 12 has a first lateral edge 50 and a second lateral edge 52 and the upper edge 40 of each bowl 32 of the plurality of bowls 32 extends between the first lateral edge 50 and the second lateral edge 52.

In use, the fastener 18 is extended through the hole 16 in the lobe portion 14 of the panel 12 to secure the panel 12 to the support surface 20 at a height desired by the user 36. Additionally, each of the bags of snacks 34 is placed in a respective one of the plurality of bowls 32 for storage. The concave shape of the plurality of bowls 32 protects the bags of snacks 34 from being crushed while the bags of snacks 34 are being stored. Consequently the bags of snacks 34 can be enjoyed by the user 36 in their intended form to maximize the satisfaction for the user 36. Furthermore, the plurality of bowls 32 eliminates the clutter that can result from bags of snacks 34 being laid on a kitchen counter, for example, prior to being consumed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A snack bag holder device for holding bags of snacks, said device comprising:

a panel having a lobe portion extending upwardly from said panel, said panel having a hole extending through said lobe portion;

a fastener being extendable through said hole wherein said fastener is configured to engage a support surface for suspending said panel on the support surface; and a plurality of bowls, each bowl of said plurality of bowls being coupled to said panel wherein each bowl of said plurality of bowls is configured to contain respective ones of the bags of snacks, each bowl of said plurality of bowls being concavely arcuate wherein each bowl of said plurality of bowls is configured to inhibit the respective bags of snacks from being crushed.

2. The snack bag holder device according to claim 1, further comprising:

said panel having a top edge and a bottom edge;

said panel being elongated between said top edge and said bottom edge; and said lobe portion extending upwardly from said top edge wherein said panel is configured to extend downwardly along the support surface from said lobe portion.

3. The snack bag holder device according to claim 2, further comprising:

said lobe portion having a distal end with respect to said top edge;

said distal end being rounded wherein said distal end is configured to inhibit snagging on an object.

4. The snack bag holder device according to claim 2, further comprising:

said panel having a front surface and a back surface wherein said back surface is configured to rest against the support surface; and said hole extending through said front surface and said back surface corresponding to said lobe portion.

5. The snack bag holder device according to claim 4, further comprising:

each bowl of said plurality of bowls having a coupled edge being coupled to said front surface of said panel;

each bowl of said plurality of bowls having an upper edge;

said upper edge of each bowl of said plurality of bowls curving forwardly from said coupled edge of a respective bowl; and said upper edge of each bowl of said plurality of bowls defining an opening into an interior of a respective bowl wherein said opening defined in each bowl of said plurality of bowls is configured to receive the respective bags of snacks.

6. The snack bag holder device according to claim 5, further comprising said upper edge of each bowl of said plurality of bowls angling downwardly from said coupled edge of a respective bowl wherein said upper edge of each bowl of said plurality of bowls is configured to expose an interior of said respective bowl to a user approaching said panel.

7. The snack bag holder device according to claim 5, further comprising:

each bowl of said plurality of bowls having an outer wall extending between said upper edge of a respective bowl and said coupled edge of said respective bowl; and said outer wall of each bowl of said plurality of bowls being concavely arcuate between said upper edge and said coupled edge wherein said outer wall of each bowl of said plurality of bowls is configured to support the bags of snacks.

8. The snack bag holder device according to claim 2, further comprising said plurality of bowls being spaced apart from each other and being evenly distributed along a line extending between said top edge of said panel and said bottom edge of said panel.

9. The snack bag holder device according to claim 2, further comprising a lowermost one of said plurality of bowls being aligned with said bottom edge of said panel.

10. The snack bag holder device according to claim 2, further comprising a topmost one of said plurality of bowls being spaced downwardly from said top edge of said panel.

11. The snack bag holder device according to claim 5, further comprising:

said panel having a first lateral edge and a second lateral edge; and said upper edge of each bowl of said plurality of bowls extending between said first lateral edge and said second lateral edge.

12. A snack bag holder device for holding bags of snacks, said device comprising:

a panel having a lobe portion extending upwardly from said panel, said panel having a hole extending through said lobe portion;

a fastener being extendable through said hole wherein said fastener is configured to engage a support surface for suspending said panel on the support surface;

wherein said panel has a top edge and a bottom edge, said panel being elongated between said top edge and said bottom edge, said lobe portion extending upwardly from said top edge wherein said panel is configured to extend downwardly along the support surface from said lobe portion, said lobe portion having a distal end with respect to said top edge, said distal end being rounded wherein said distal end is configured to inhibit snagging on an object, said panel having a front surface and a back surface wherein said back surface is configured to rest against the support surface, said hole extending through said front surface and said back surface corresponding to said lobe portion; and a plurality of bowls, each bowl of said plurality of bowls being coupled to said panel wherein each bowl of said plurality of bowls is configured to contain respective ones of the bags of snacks, each bowl of said plurality of bowls being concavely arcuate wherein each bowl of said plurality of bowls is configured to inhibit the respective bags of snacks from being crushed, each bowl of said plurality of bowls having a coupled edge being coupled to said front surface of said panel, each bowl of said plurality of bowls having an upper edge, said upper edge of each bowl of said plurality of bowls curving forwardly from said coupled edge of a respective bowl, said upper edge of each bowl of said plurality of bowls defining an opening into an interior of a respective bowl wherein said opening defined in each bowl of said plurality of bowls is configured to receive the respective bags of snacks, said upper edge of each bowl of said plurality of bowls angling downwardly from said coupled edge of a respective bowl wherein said upper edge of each bowl of said plurality of bowls is configured to expose an interior of said respective bowl to a user approaching said panel, each bowl of said plurality of bowls having an outer wall extending between said upper edge of a respective bowl and said coupled edge of said respective bowl, said outer wall of each bowl of said plurality of bowls being concavely arcuate between said upper edge and said coupled edge wherein said outer wall of each bowl of said plurality of bowls is configured to support the bags of snacks, said plurality of bowls being spaced apart from each other and being evenly distributed along a line extending between said top edge of said panel and said bottom edge of said panel, a lowermost one of said plurality of bowls being aligned with said bottom edge of said panel, a topmost one of said plurality of bowls being spaced downwardly from said top edge of said panel, said panel having a first lateral edge and a second lateral edge, said upper edge of each bowl of said plurality of bowls extending between said first lateral edge and said second lateral edge.

* * * * *